US008807556B2

(12) United States Patent
Sugiyama et al.

(10) Patent No.: US 8,807,556 B2
(45) Date of Patent: Aug. 19, 2014

(54) SHEET CONVEYING APPARATUS, PRINTING APPARATUS, AND PROCESSING APPARATUS

(75) Inventors: Noriyuki Sugiyama, Kawasaki (JP); Hiroyuki Saito, Yokohama (JP); Atsushi Ikeda, Tokyo (JP); Yasuyuki Hirai, Yokohama (JP); Noriko Sato, Kawasaki (JP); Masashi Ito, Yokohama (JP); Fumie Kameyama, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/529,229

(22) Filed: Jun. 21, 2012

(65) Prior Publication Data

US 2013/0001859 A1 Jan. 3, 2013

(30) Foreign Application Priority Data

Jun. 30, 2011 (JP) ..... 2011-145575

(51) Int. Cl.

| | |
|---|---|
| ***B65H 3/52*** | (2006.01) |
| ***B65H 3/66*** | (2006.01) |
| ***B65H 3/34*** | (2006.01) |
| ***B65H 3/06*** | (2006.01) |
| ***B65H 3/56*** | (2006.01) |

(52) U.S. Cl.

CPC ..... *B65H 3/0684* (2013.01); *B65H 3/66* (2013.01); *B65H 3/34* (2013.01); *B65H 2511/214* (2013.01); *B65H 2511/416* (2013.01); *B65H 2301/4222* (2013.01); *B65H 2403/512* (2013.01); *B65H 3/56* (2013.01); *B65H 2405/1136* (2013.01); *B65H 2405/1134* (2013.01); *B65H 2515/81* (2013.01)

USPC ..... 271/124; 271/167

(58) Field of Classification Search

USPC ..... 271/124, 167

See application file for complete search history.

(56) References Cited

U.S. PATENT DOCUMENTS

| | | | | |
|---|---|---|---|---|
| 5,449,162 | A | | 9/1995 | Saito et al. |
| 5,527,029 | A | * | 6/1996 | Bortolotti et al. ..... 271/124 |
| 5,580,042 | A | | 12/1996 | Taniguro et al. |
| 5,620,174 | A | | 4/1997 | Taniguro et al. |
| 5,672,019 | A | | 9/1997 | Hiramatsu et al. |
| 5,725,206 | A | | 3/1998 | Sugiyama |
| 5,725,319 | A | | 3/1998 | Saito et al. |
| 5,775,823 | A | | 7/1998 | Bekki et al. |
| 5,918,873 | A | | 7/1999 | Saito et al. |

(Continued)

FOREIGN PATENT DOCUMENTS

JP 2005-254771 9/2005

*Primary Examiner* — David H Bollinger

(74) *Attorney, Agent, or Firm* — Fitzpatrick, Cella, Harper & Scinto

(57) ABSTRACT

Even in printing apparatus that make use of a plurality of kinds of sheets, the degradation of image quality is reduced. A sheet conveying apparatus includes: a sheet stacking unit; a sheet conveying unit being in contact with the sheet stacked on an uppermost portion, of the stacked sheets, and conveying the sheet; a separation unit separating the sheets into only one sheet of the uppermost portion by a separation slope that abuts a tip portion of the sheet conveyed by the sheet conveying unit; and a guide unit connected to the separation unit and guiding the sheet, in which an angle between the sheet stacking unit and the separation slope is switched to a first angle and a second angle smaller than the first angle by a rotation center of the separation unit provided in a vicinity of a connection portion of the separation unit and the guide unit.

13 Claims, 10 Drawing Sheets

(56) References Cited

U.S. PATENT DOCUMENTS 6,106,114 A 8/2000 Sugiyama
6,168,270 B1 1/2001 Saikawa et al.
6,305,682 B1 10/2001 Saito et al.
6,382,621 B1 * 5/2002 Inoue et al. ..... 271/120
6,454,477 B1 9/2002 Sugiyama

* cited by examiner

SHEET CONVEYING APPARATUS, PRINTING APPARATUS, AND PROCESSING APPARATUS

BACKGROUND OF THE INVENTION

1. Field of the Invention

The present invention relates to a sheet conveying apparatus, a printing apparatus, and a processing apparatus being provided in apparatuses handling sheets and including a sheet conveying unit that separates a plurality of kinds of sheets one by one by the same separation unit and conveys the separated sheet to the subsequent process.

2. Description of the Related Art

In printing apparatus, sheets are generally separated one by one by a separation slope from a sheet stacking unit in which the sheets are stacked. Then, while the sheet is grasped firmly by a sheet conveying roller, the sheet is guided to a conveyance guide, and is conveyed to a printing mechanism.

In printing apparatus that make use of a plurality of kinds of sheets, techniques have been known in which in order to perform separation in accordance with sheets from a sheet stacking unit in which the sheets are stacked, the rotation center is provided in the vicinity of the upstream side end portion in the conveyance direction of the sheets, and the angle of a separation slope is made variable in accordance with the kind of sheet (for example, see Japanese Patent Laid-Open No. 2005-254711).

However, the rotation center of the separation slope is provided in the vicinity of the upstream side end portion in the conveyance direction of sheets, and thus, when the angle of the separation slope is changed, a step is generated in the joint portion of the separation slope and the guide member of the sheet conveyance path on the downstream side from the separation slope. The problem is caused in which conveyance by a sheet conveying roller is not straightly performed, or the like, and thus image quality may be degraded.

When sheet conveying pressure by the sheet conveying roller becomes larger, overlapped conveying easily occurs. Such a force is generated when the sheet conveying roller abuts a sheet. In addition, when the opposing force applied to the sheet by the separation slope becomes smaller, overlapped conveying easily occurs. Such a force is generated when the sheet conveying roller abuts the sheet.

At any rate, when a problem is caused in sheet conveyance, there is a possibility that the quality of a printed image is degraded.

SUMMARY OF THE INVENTION

The present invention has been made in view of the above-described points. Even in printing apparatus that make use of a plurality of kinds of sheets, the present invention provides a sheet conveying apparatus, a printing apparatus, and a processing apparatus, which reduce the degradation of image quality.

Therefore, according to the present invention, there is provided a sheet conveying apparatus that conveys sheets, which includes: a sheet stacking unit stacking the sheets; a sheet conveying unit being in contact with the sheet stacked on an uppermost portion, of the stacked sheets, and conveying the sheet; a separation unit separating the sheets into only one sheet of the uppermost portion by a separation slope that abuts a tip portion of the sheet conveyed by the sheet conveying unit; and a guide unit connected to the separation unit and guiding the sheet, in which an angle between the sheet stacking unit and the separation slope is switched to a first angle and a second angle smaller than the first angle by a rotation center of the separation unit provided in a vicinity of a connection portion of the separation unit and the guide unit.

According to the above-described configuration, the rotation center of the separation slope is provided in the vicinity of the connection portion of the separation unit and the conveyance guide unit. The angle of the separation slope that can separate two or more sheets is made variable. Because of this, a step is not generated in the joint portion of the separation slope and the guide member of the sheet conveyance path on the downstream side from the separation slope, and two or more sheets can be separated, and thus the degradation of image quality can be suppressed.

Further features of the present invention will become apparent from the following description of exemplary embodiments (with reference to the attached drawings).

DESCRIPTION OF THE EMBODIMENTS

Hereinafter, embodiments of the present invention will be described in detail with reference to the drawings.

First Embodiment

Figure 1:
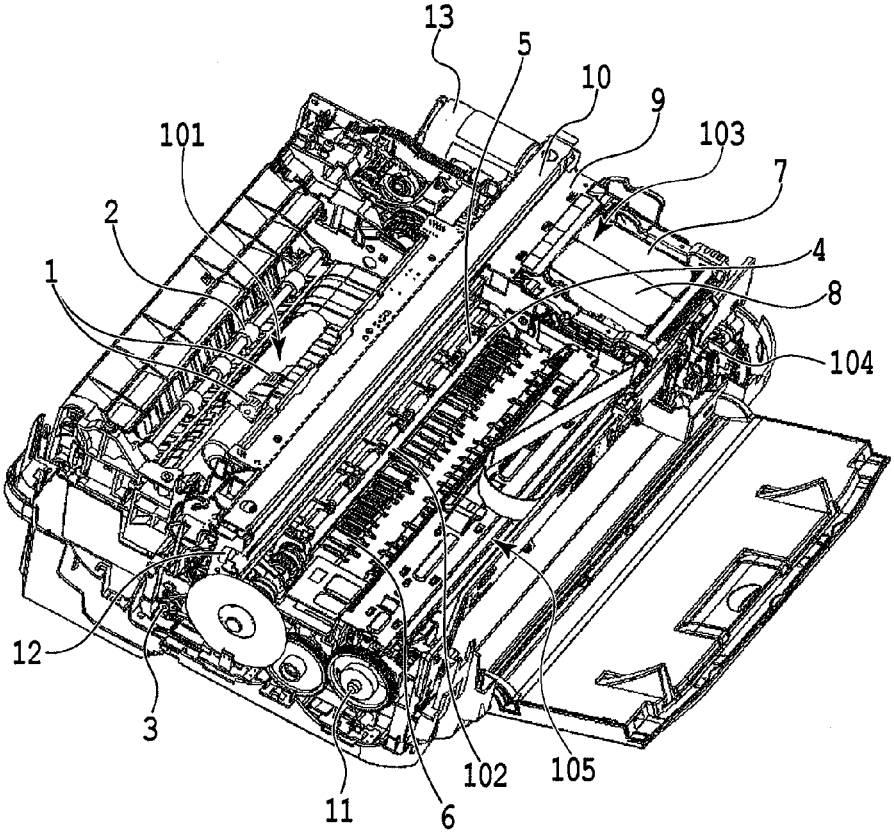
FIG. 1 is a perspective view showing an inkjet printing apparatus according to a first embodiment.

FIG. 1 is a perspective view showing an inkjet printing apparatus according to the present embodiment. Sheets stacked in a sheet conveying unit 101 is separated one by one by the separation of the sheet stacked on the uppermost portion through the use of: a sheet conveying roller 1 serving as a sheet conveying unit that is driven by a sheet conveying motor and conveys the sheet; and a separation slope 2. The separated sheets are conveyed to a conveyance unit 102. The sheet conveyed to the conveyance unit 102 is conveyed on a platen 6 by a sheet conveying roller 4 driven by a conveyance motor 3, and by pinch rollers 5.

A printing mechanism unit 103 prints an image and the like on the sheet based on image information. Specifically, a printing head 7 and a printing head 8 are mounted on a carriage 9, the carriage 9 is guided and supported by a guide rail 10, and the carriage 9 reciprocatingly moves n the direction (main-scanning direction) perpendicular to the conveyance direction (sub-scanning direction) of the sheet via a carriage belt 12 by a carriage motor 13. The printing head 7, while reciprocatingly moving the main-scanning direction, ejects ink based on the image information, and by simultaneously repeating conveyance in the sub-scanning direction of the sheet conveyed on the platen 6, the printing head 7 performs printing on the entire sheet. The printed sheet is ejected to the outside of the printing apparatus body by a sheet eject roller 11 driven in synchronization with the conveyance motor 3 and a spur pressed by the sheet eject roller 11.

A recovery mechanism unit 104 maintains and recovers an ink eject property of the printing head in order to maintain the quality of an image to be printed. A sheet discharge unit 105 discharges, to the outside of the printing apparatus body, the sheet on which the image is formed.

Next, a condition under which, in the present embodiment, sheet conveying (hereinafter, also referred to as an "overlapped conveying") is not performed while two or more sheets overlap will be described.

Figure 2:
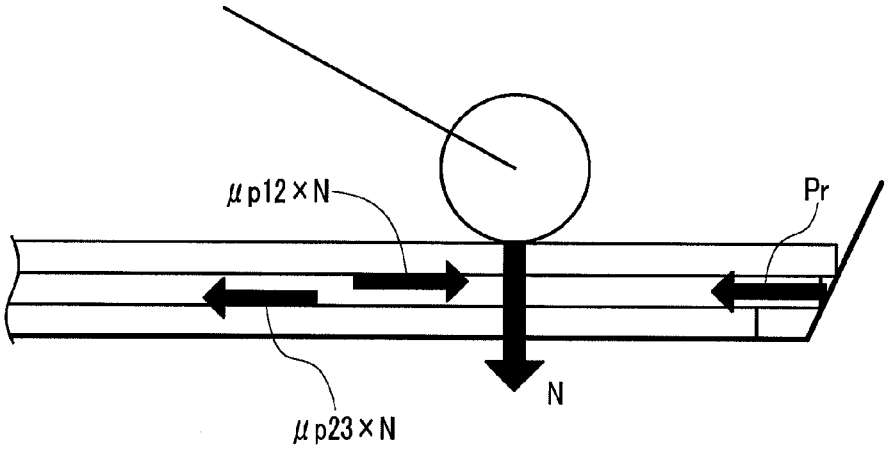
FIG. 2 is a conceptual diagram showing a separated state of two or more sheets.

FIG. 2 is a conceptual diagram showing a separated state of two or more sheets. The condition under which overlapped conveying is not performed is at the time when the following formulas are satisfied.

When the friction coefficient between a first sheet and a second sheet is equal to μp12, the friction coefficient between the second sheet and a third sheet is equal to μp 23, the sheet conveying pressure by the sheet conveying roller is equal to N, and the opposing force applied to the sheet by the separation slope is equal to Pr, $$(\mu p12-\mu p23)\times N\leq Pr.$$

That is, in accordance with the above-described formulas, when the sheet conveying pressure N by the sheet conveying roller becomes larger, it becomes difficult to perform overlapped conveying. In addition, when the opposing force applied to the sheet by the separation slope becomes smaller, it is easy to perform overlapped conveying.

Figure 3:
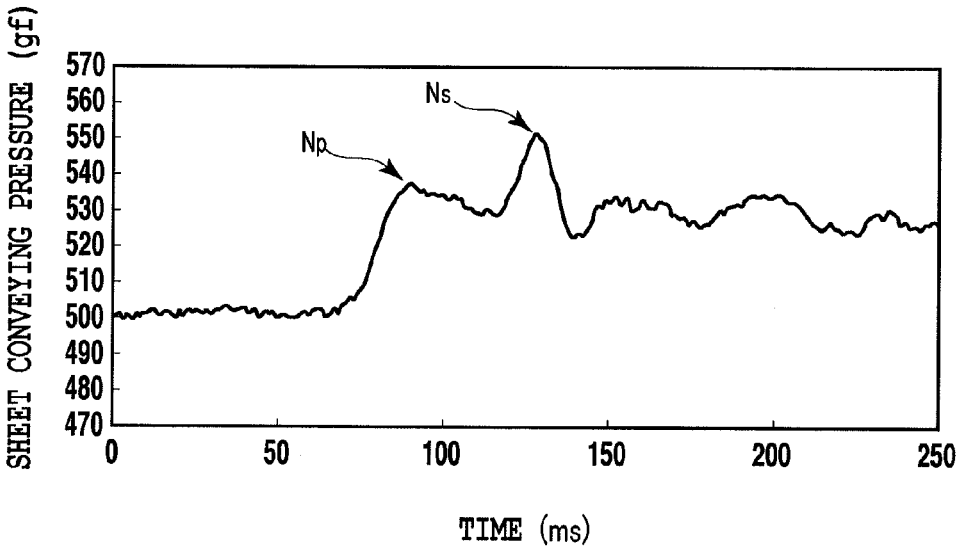
FIG. 3 is a graph showing a sheet conveying pressure applied to the sheet by a sheet conveying roller at the time of sheet conveying.

FIG. 3 is a graph showing a sheet conveying pressure applied to the sheet by the sheet conveying roller at the time of sheet conveying. Peak values referred to as a first peak $N_p$ generated when the sheet conveying roller abuts the sheet and a second peak $N_s$ generated when the tip of the sheet abuts the separation slope are generated. That is, when the tip of the sheet is near the separation slope at the time of the start of sheet conveying, $N_p$ and $N_s$ tend to overlap with each other and N value becomes larger than the case where $N_p$ and $N_s$ exist apart.

At this time, the rigidity of a sheet having a weight of about 100 g/m$^2$ or less such as plain paper is lower than the rigidity of a sheet with a basis weight of about 100 g/m$^2$ or more such as gloss paper, and thus, in the above-described formulas, Pr of a sheet having low rigidity is smaller than Pr of a sheet having high rigidity, and it is easy to perform overlapped conveying.

Therefore, the setting position of a sheet having low rigidity such as plain paper may be configured so as to be farther from the separation slope than the setting position of a sheet having high rigidity such as gloss paper so that $N_p$ and $N_s$ do not overlap with each other.

Next, the change in the state of the separation slope 2 of the sheet conveying unit 101 of the present embodiment will be described with reference to FIGS. 4 to 8.

Figure 4:
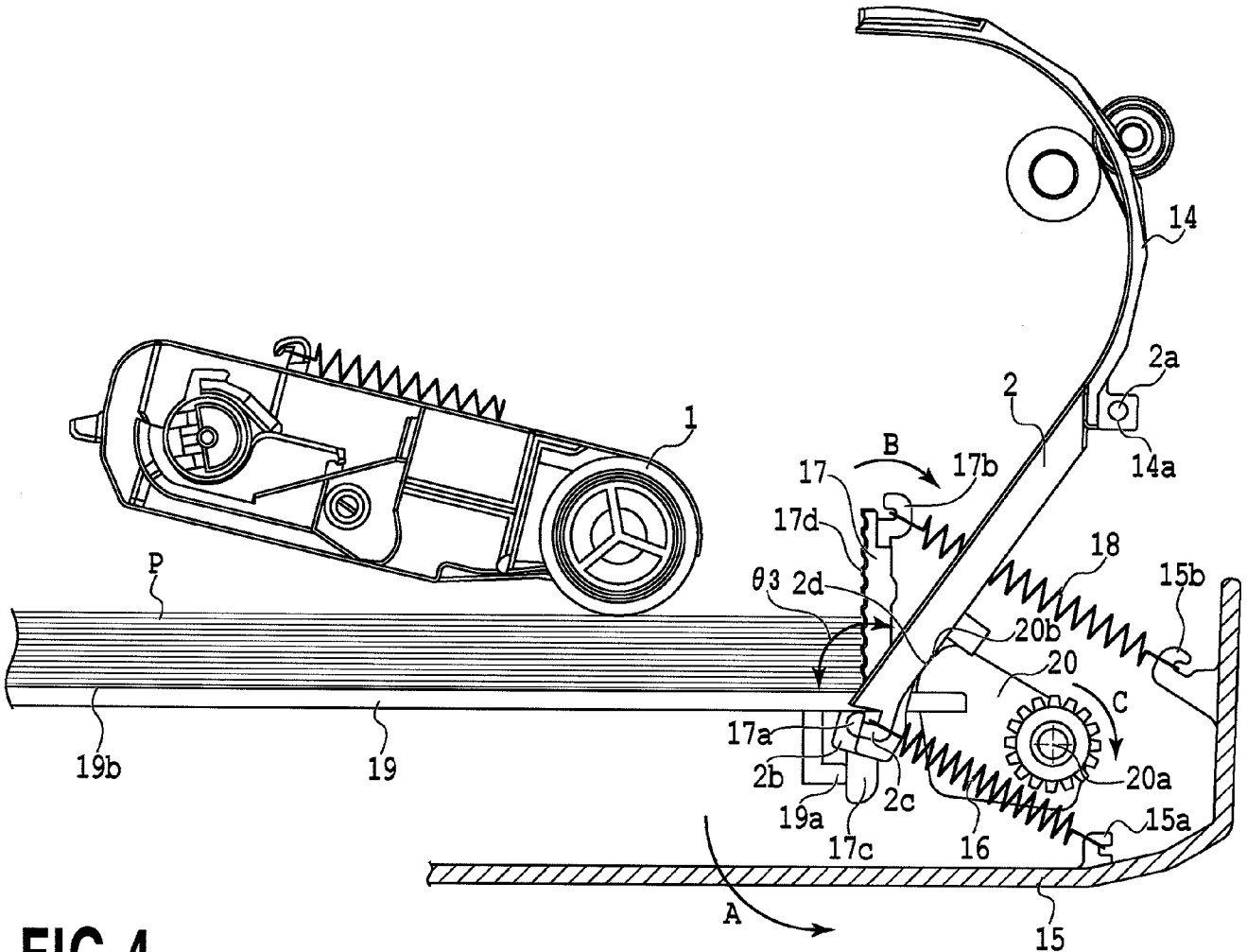
FIG. 4 is a cross-sectional view showing a state where a sheet is set to the printing apparatus according to the first embodiment.
Figure 5:
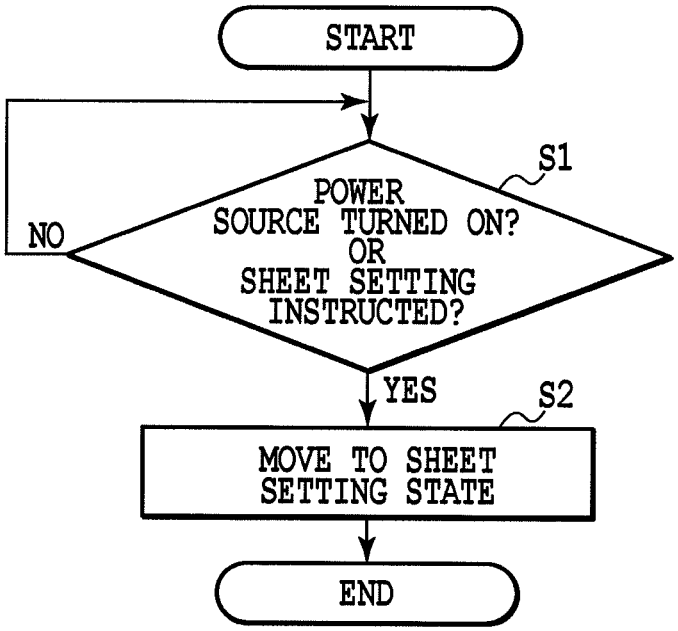
FIG. 5 is a flow chart until a sheet is set in the first embodiment.

FIG. 4 is a cross-sectional view showing a state where a sheet is set to the printing apparatus of the present embodiment. In addition, FIG. 5 is a flow chart showing a flow until the sheet is set to the printing apparatus of the present embodiment. When the power source of the inkjet printing apparatus is turned on or an instruction for setting the sheet is received (step S1), the separation slope 2 is brought into a sheet setting state, i.e., the state (step S2) shown in FIG. 4.

With reference to FIG. 4, the separation slope 2 includes a rotation center shaft 2*a* in the vicinity of the downstream side end portion in the conveyance direction of a sheet P, a rotation center hole 2*b*, and a spring gab portion 2*c* in the vicinity of the upstream side end portion in the conveyance direction. In addition, a conveyance guide 14 connected to the separation slope includes a rotation center hole 14*a* in the vicinity of the upstream side end portion in the conveyance direction of the sheet F, i.e., in the vicinity of the connection portion of the separation slope and the conveyance guide 14. The rotation center shaft 2*a* of the separation slope 2 is inserted in this rotation center hole 14*a*, and the separation slope 2 is provided rotatably around the rotation center hole 14*a*.

By hanging a tension spring 16 between the spring gab portion 15*a* provided in a base 15 and the spring gab portion 2*c* provided in the separation slope 2, the separation slope 2 is urged to the side turned around the rotation center hole 14*a* in an arrow A direction in FIG. 4.

In addition, a tip portion 20*b* of a rotating cam 20 abuts a support portion 2*d* of the separation slope 2. The tip portion 20*b* is at a distance of 15 mm from a center 20*a* of the rotating cam 20, and the distance from the tip portion 20*b* to the center 20*a* is about 15 mm in the range of about 20° around the center 20*a*. Then, in the separation slope 2 abutting the tip portion 20*b* of the rotating cam 20, the rotation in the arrow A direction shown in FIG. 4 is restricted, and separation slope 2 is stopped in the sheet setting state.

A rotation center shaft 17*a* provided in one end portion of a sheet tip position determining member 17 is inserted into the rotation center hole 2*b* of the separation slope 2, and the sheet tip position determining member 17 is provided rotatably around the rotation center hole 2*b*. Then, a spring gab portion 17*b* is provided in the other end portion of the rotation center shaft 17*a*, and a tension spring 18 is hung between the spring gab portion 17*b* and a spring gab portion 15*b* provided in the base 15. Because of this, the sheet tip position determining member 17 is urged to the side rotating around the rotation center hole 2*b* in an arrow B direction shown in FIG. 4. At this time, in the sheet setting state, a rotation restriction portion 17*c* of the sheet tip position determining member 17 abuts a rotation restriction portion 19*a* provided in the sheet stacking unit 19 provided in order to stack and set the sheet P. Because of this, the rotation of the sheet tip position determining member 17 in the arrow B direction shown in FIG. 4 is restricted, and the sheet tip position determining member 17 is stopped in the sheet setting state where the sheet tip position determining member 17 is at a position approximately perpendicular to a sheet stacking surface 19*b* of the sheet stacking portion 19. At this time, an angle θ3 configured by the sheet stacking surface 19*b* and the separation slope 2 is set to about 125°.

In addition, in the sheet setting state, when the sheet P is set on the sheet stacking surface of the sheet stacking portion 19, it is possible to set the sheet P, by causing the downstream side tip portion in the conveyance direction of the sheet P to abut a tip position determining surface 17*d* of the sheet tip position determining member 17.

Figure 6:
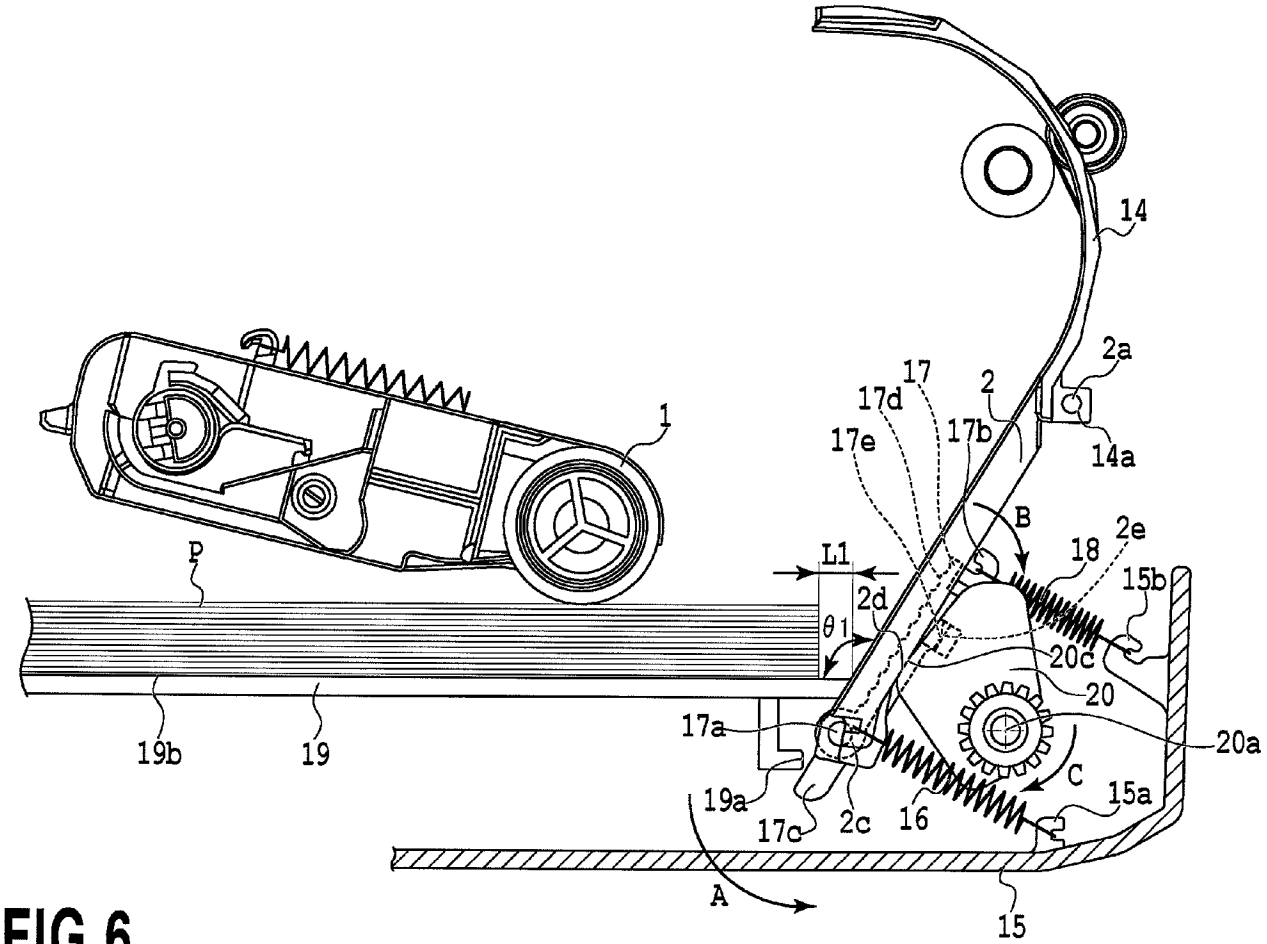
FIG. 6 is a cross-sectional view showing the time when a sheet having high rigidity is conveyed in the first embodiment.
Figure 7:
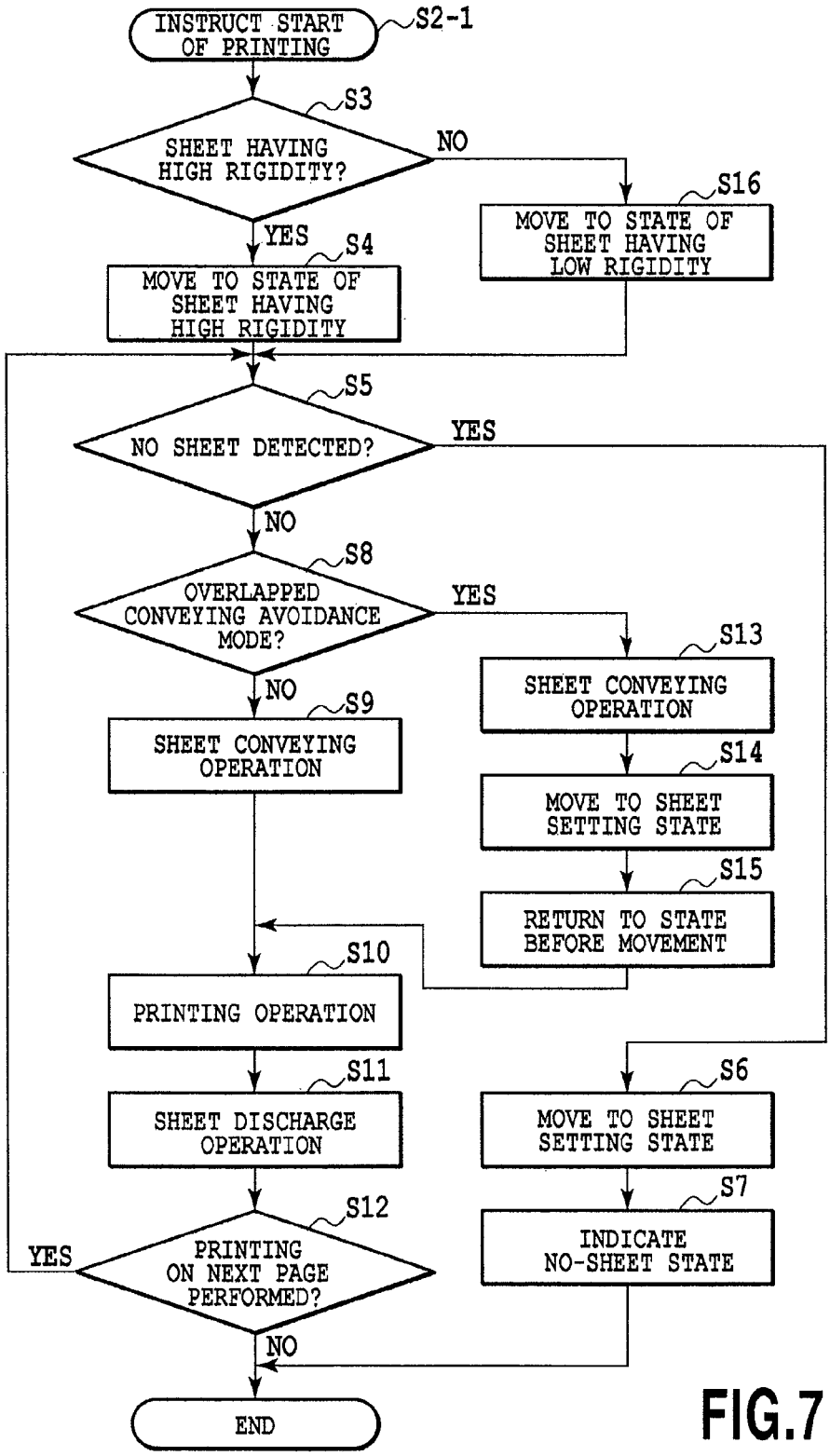
FIG. 7 is a flow chart showing when an instruction of the start of printing is preformed in the first embodiment.

FIG. 6 is a cross-sectional view showing a state of the separation slope when a sheet having a weight of about 100 g/m$^2$ or more and having high rigidity such as gloss paper is conveyed as the sheet P to the printing apparatus of the present embodiment. In addition, FIG. 7 is a flow chart showing a flow when an instruction of the start of printing on the sheet is preformed to the printing apparatus.

When an instruction of the start of printing on the sheet P via a PC or the like from a user is performed (step S2-1), the determination of whether or not the instruction is an instruction for using a sheet having high rigidity is performed (step S3). When the instruction is an instruction for performing printing on a sheet having high rigidity, the separation slope 2 is switched to a state where printing on a sheet having high rigidity is performed (step S4).

Hereinafter, a process in which the state shown in FIG. 4 where a sheet is set to the printing apparatus is switched to a state where a sheet having high rigidity is conveyed will be described with reference to FIGS. 4 and 6.

The rotating cam 20 rotates about 50° in an arrow C direction shown in FIG. 4, and stops at the position shown in FIG. 6. At this time, the separation slope 2 is urged to the side rotating in the arrow A direction shown in FIG. 4 due to the elastic force of the tension spring 16, and thus the separation slope 2 rotates in the arrow A direction shown in FIG. 4 following the rotation of the rotating cam 20. Then, when the rotation of the rotating cam 20 stops, the rotation of the separation slope 2 also stops.

Then, when being at the position shown in FIG. 6, a tip portion 20*c* of the rotating cam 20 is brought into a state of abutting the support portion 2*d* of the separation slope 2. The tip portion 20*c* is at a distance of 12 mm from the center 20*a* of the rotating cam 20, and the distance from the tip portion 20*c* to the center 20*a* is about 12 mm in the range of about 20° around the center 20*a*. At this time, an angle θ1 configured by the sheet stacking surface 19*b* and the separation slope 2 is set to about 117°, and the minimum distance L1 from the tip portion of the sheet P to the separation slope 2 is set to about 3 mm.

In addition, the rotation center shaft 17*a* of the sheet tip position determining member 17 is inserted into the rotation center hole 2*b* of the separation slope 2, and thus the sheet tip position determining member 17 rotates and in addition, switches in the arrow A direction shown in FIG. 4 around the rotation center hole 14*a* of the separation slope 2.

Then, due to this switch, the rotation restriction portion 17*c* of the sheet tip position determining member 17 is separated from the rotation restriction portion 19*a* provided in the sheet stacking unit 19. Because of this, the sheet tip position determining member 17 rotates in the arrow B direction shown in FIG. 6 around the rotation center hole 2*b* due to the elastic force of the tension spring 18 hung on the spring gab portion 17*b*.

At this time, an abutment portion 17*e* provided in the sheet tip position determining member 17 abuts a support portion 2*e* provided in the separation slope 2, and then, the rotation of the sheet tip position determining member 17 in the arrow B direction shown in FIG. 6 stops. Because of this, the tip position determining surface 17*d* of the sheet tip position determining member 17 is completely housed in the separation slope 2, and retreats from the conveyance path of the sheet P.

When the separation slope 2 is brought into a state of conveying a sheet having high rigidity, the determination of whether or not there is no sheet P is performed (step S5). When it is determined that there is no sheet, the rotating cam 20 is rotated about 50° in the direction opposite to the arrow C direction shown in FIG. 6 from the state shown in FIG. 6, and is switched to the sheet setting state shown in FIG. 4 (step S6). Then, the processing indicates that there is no sheet, and ends (step S7).

In contrast, when there is the sheet P (step S5), it is determined whether or not the user performs the instruction and input of an overlapped conveying avoidance mode from the PC or the like (step S8). This overlapped conveying avoidance mode is a mode selected when the sheets P are conveyed that are easy to be conveyed in a state where two or more sheets overlap in the conveyance of the sheets P by the sheet conveying roller 1. When it is determined that the designation of the overlapped conveying avoidance mode is not performed, sheets are conveyed without doing anything (step S9), and printing on the conveyed sheet is performed (step S10). Then, the printed sheet is discharged to the outside of the printing apparatus (step S11). Then, it is determined whether or not there is information to be printed on the next page (step S12). When there is no information to be printed on the next page, a series of operations from the start of printing are completed. In contrast, when there is information to be printed on the next page, the processing returns to step S5, and the above-described operation is repeated.

In contrast, when it is determined that the user performs the designation of the overlapped conveying avoidance mode (step S8), sheets are conveyed (step S13). Then, the rotating cam 20 is rotated about 50° in the direction opposite to the arrow C direction shown in FIG. 6 from the current state of the separation slope 2 (the state shown in FIG. 6), and is returned to the sheet setting state (the state shown in FIG. 4) (step S14). By this operation, it is possible to prevent the downstream side tip portions in the conveyance direction of the sheets P other than one sheet of the uppermost layer, from coming close to the separation slope 2 by sheet conveying operation, and to prevent Li from becoming shorter.

When the separation slope 2 is returned to the sheet setting state, the rotating cam 20 is again rotated about 50° in the arrow C direction shown in FIG. 4, and then, the state of the separation slope 2 is switched to the state where a sheet having a weight of about 100 g/m$^2$ or more and having high rigidity such as gloss paper is conveyed as the sheet P (step S15). Then, printing on the sheet is performed. When there is no information to be printed on the next page, a series of operations from the start of printing are completed. In contrast, when there is information to be printed on the next page, the processing returns to step S5, and the above-described operation is repeated.

Figure 8:
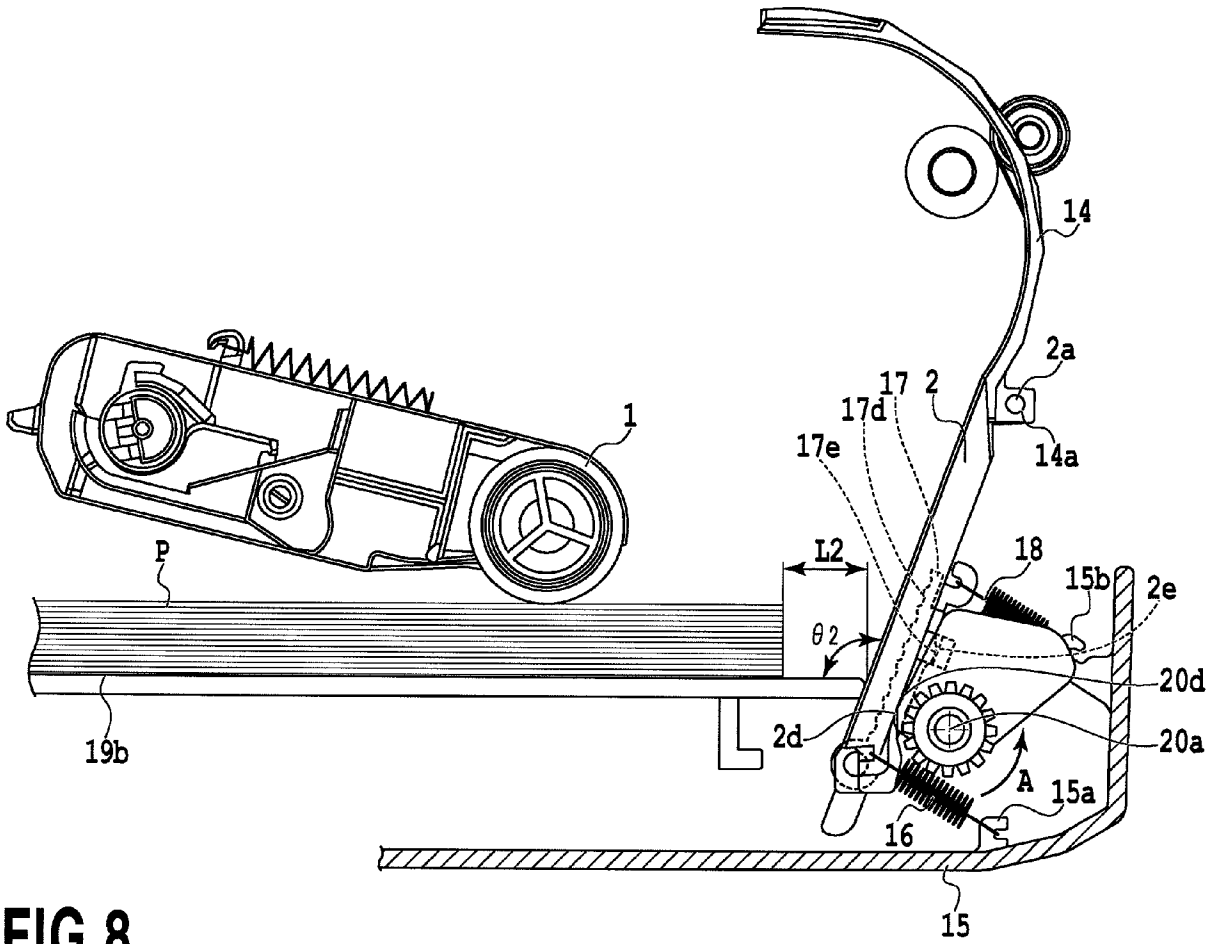
FIG. 8 is a cross-sectional view showing the time when a sheet having low rigidity is conveyed in the first embodiment.

FIG. 8 is a cross-sectional view showing a state of the separation slope when a sheet having a weight of about 100 g/m$^2$ or less and having low rigidity, such as gloss paper is conveyed as the sheet P to the printing apparatus of the present embodiment. Referring again to FIG. 7, when an instruction of start of printing on the sheet P via the PC or the like, from the user is performed (step S2-1), the determination of whether or not the instruction is an instruction for using a sheet having high rigidity is performed (step S3). When the instruction is an instruction for performing printing on a sheet having low rigidity, the separation slope 2 is switched to a state where printing on a sheet having low rigidity is performed (step S16).

Hereinafter, a process in which the state shown in FIG. 4, where a sheet is set to the printing apparatus is switched to the state where a sheet having low rigidity is conveyed will be described with reference to FIGS. 4 and 8.

The rotating cam 20 is turned about 110° in the arrow C direction shown in FIG. 4, and is stopped at the position shown in FIG. 8. At this time, the separation slope 2 is urged to the side turned in the arrow A direction shown in FIG. 4 due to the elastic force of the tension spring 16, and thus the separation slope 2 is turned in the arrow A direction shown in FIG. 4 following the rotation of the rotating cam 20. Then, when the rotation of the rotating cam 20 is stopped, the rotation of the separation slope 2 also is stopped.

Then, in the state shown in FIG. 8, a tip portion 20*d* of the rotating cam 20 abuts the support portion 2*d* of the separation slope 2. The tip portion 20*d* is at a distance of 6.5 mm from the center 20*a* of the rotating cam 20, and the distance from the tip portion 20*d* to the center 20*a* is about 6.5 mm in the range of about 40° around the center 20*a*. At this time, an angle θ2 configured by the sheet stacking surface 19*b* and the separation slope 2 is set to about 110°, and the minimum distance L2 from the tip portion of the sheet P to the separation slope 2 is set to about 10 mm.

Furthermore, in a manner similar to the state described in FIG. 6, the sheet tip position determining member 17 rotates and in addition, switches in the arrow A direction shown in FIG. 4 around the rotation center hole 14*a* of the separation slope 2. Then, the rotation restriction portion 17*c* of the sheet tip position determining member 17 is separated from the rotation restriction portion 19*a* provided in the sheet stacking portion 19, successively from the state shown in FIG. 6, and thus the positional relationship between the separation slope 2 and the sheet tip position determining member 17 is maintained in a manner similar to the case of sheets having high rigidity.

That is, the abutment portion 17*e* provided in the sheet tip position determining member 17 abuts a support portion 2*e* provided in the separation slope 2 to be in a state of being stopped, and the tip position determining surface 17*d* of the sheet tip position determining member 17 retreats from the conveyance path of the sheet P.

When sheets having low rigidity are selected in step S3 and it is determined that there is no sheet in step S5, the separation slope is in the state shown in FIG. 8, and thus the rotating cam 20 is turned about 110° in the arrow A direction shown in FIG. 8 from this state. Then, the rotating cam 20 is returned to the sheet setting state shown in FIG. 4.

In addition, when the overlapped conveying avoidance mode is selected and switching to the sheet setting state is performed (step S14), the rotating cam 20 is rotated about 110° in the arrow A direction shown in FIG. 8 from the state shown in FIG. 8, and is returned to the sheet setting state shown in FIG. 4. Because of this, it is possible to prevent the downstream side tip portions in the conveyance direction of the sheets P other than one sheet of the uppermost layer, from coming close to the separation slope 2 by sheet conveying operation, and to prevent L2 from becoming shorter. Then, when being returned to the state before switch (step S15), the rotating cam 20 is rotated about 110° in the arrow C direction shown in FIG. 4, and the state of the separation slope 2 is switched to the state shown in FIG. 8.

As described above, the rotation center of the separation slope 2 is provided in the vicinity of the upstream side end portion in the sheet conveyance direction, of the conveyance guide 14, and thus, even when the angle of the separation slope 2 is made variable, a step is not generated in the joint portion of the separation slope 2 and the conveyance guide 14 and there is no adverse effect on the accuracy of image printing on sheets.

In addition, setting is performed so that the relationship between the minimum distance L2 from the tip portion of the sheet P to the separation slope 2 when the sheet having low rigidity is conveyed and the minimum distance L1 from the tip portion of the sheet P to the separation slope 2 when the sheet having high rigidity is conveyed is L1<L2. Because of this, it is possible to suppress the sheet conveying pressure by the sheet conveying roller, on sheets having low rigidity relative to that on sheets having high rigidity, and to enhance separation characteristics.

Furthermore, due to a configuration in which the sheet tip position determining member 17 is rotatably attached to the separation slope 2, it is possible to accurately determine the disposition of the sheet tip position determining member 17 relative to the separation slope 2. Because of this, the sheet tip position determining member 17 can be provided by an inexpensive and highly accurate configuration.

Second Embodiment

In the first embodiment, the state of the separation slope 2 is switched based on the information of a printing driver. However, in the present embodiment, the separation slope is switched by torque information of a sheet conveying motor driving source when the end portion in the downstream direction in the conveyance direction of a sheet abuts the separation slope 2.

Figure 9:
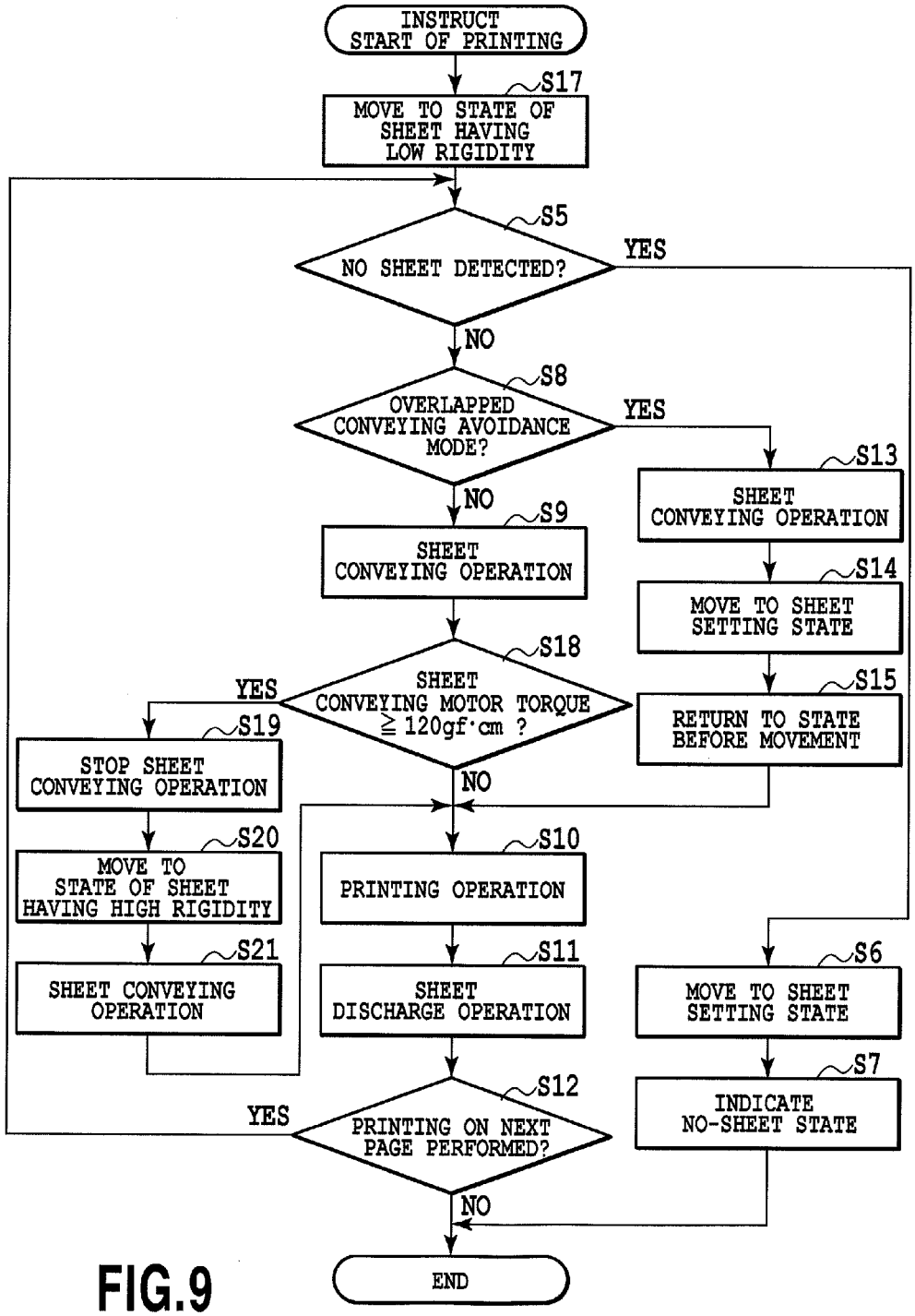
FIG. 9 is a flow chart showing the start to the end of printing in a second embodiment.

FIG. 9 is a flow chart showing a flow from an instruction of the start of printing on a sheet to the end of printing in the present embodiment. Hereinafter, parts different from the flow of printing in the first embodiment will be mainly described.

In the present embodiment, when an instruction of the start of printing on the sheet P is performed via the PC or the like from a user, the separation slope 2 is switched to the state where a sheet having low rigidity is conveyed (step S17). Then, after whether or not there is no sheet is detected (step S5), and the presence or absence of the overlapped conveying avoidance mode is determined (step S8), sheet conveying operation is started (step S9).

If sheet conveying operation is started (step S9), the detection of whether or not torque information of the sheet conveying motor at the time when the downstream side tip portion in the conveyance direction of the sheet P abuts the separation slope 2 is 120 gf·cm or more is performed form a current value for instructing the sheet conveying motor (step S18). When it is determined that the torque information of the sheet conveying motor is 120 gf·cm or more, the sheet conveying operation is once stopped (step S19). Then, the separation slope 2 is switched to the state where a sheet having high rigidity is conveyed (step S20). Then, sheet conveying operation is resumed (step S21).

That is, the state of the separation slope 2 is switched from the state shown in FIG. 6 to the state shown in FIG. 5 described in the first embodiment. Because of this, the rotating cam 20 is turned about 60° in the arrow A direction shown in FIG. 6, and thus the separation slope is switched from the state shown in FIG. 6 to the state shown in FIG. 5 in which a sheet having high rigidity is conveyed.

Because of this, the angle configured by the sheet stacking surface 19*b* and the separation slope 2 is changed from about 110° to about 117°, and thus it is possible to reduce torque of the sheet conveying motor in the subsequent sheet conveying operation. Therefore, it is possible to prevent the sheet P from not being able to be conveyed due to the insufficiency of the torque of the sheet conveying motor.

As described above, by performing the movement of the state of the separation slope 2 from the detection of the torque of the sheet conveying motor, the state of the separation slope may be determined.

In this way, when the state of the separation slope 2 is determined and switched by the detection of the torque of the sheet conveying motor, it is possible to produce an effect similar to that of the first embodiment, even when the kind of sheet P a user selects is erroneously selected.

Meanwhile, instead of determination by the detection of the torque of the sheet conveying motor, whether or not the sheet P is conveyed to the subsequent process by sheet conveying operation is determined, and when it is determined that the sheet P is not conveyed, the operation for changing the state of the separation slope may be performed. Even if this kind of manner is used, it is possible to produce an effect similar to that of the determination by the detection of the torque of the sheet conveying motor.

Third Embodiment

In the above-described embodiments, although the sheet tip position determining member 17 is configured to be rotatably attached to the separation slope 2, the present invention may not be configured that way.

Figure 10:
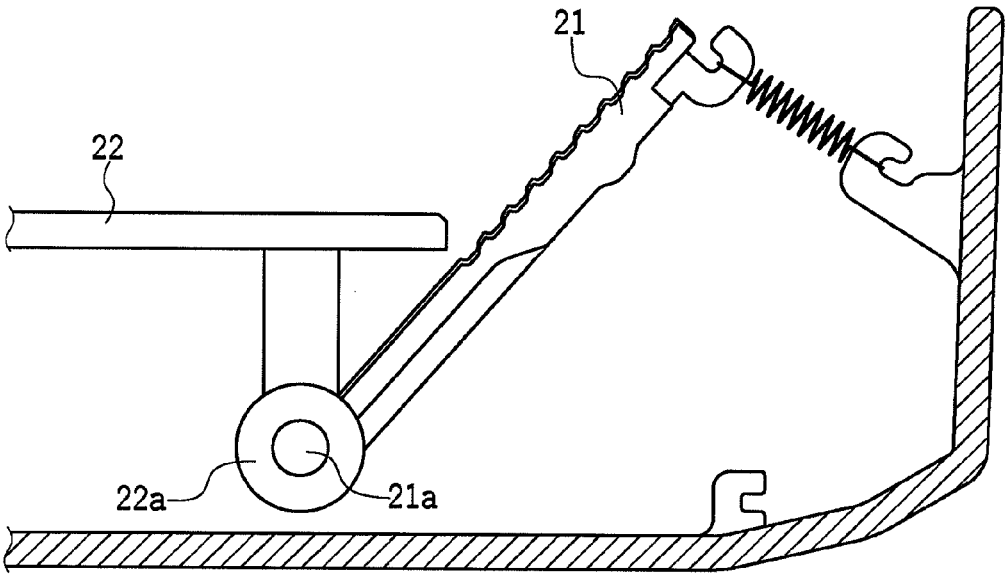
FIG. 10 is an enlarged view showing a tip position determining member according to a third embodiment.

FIG. 10 is an enlarged view showing a sheet tip position determining member and the periphery thereof according to the present embodiment. In a sheet tip position determining member 21 according to the present embodiment, a rotation center shaft 21*a* is rotatably inserted into a rotation center hole 22*a* of a stacking portion 22. Then, a cam portion for moving also the sheet tip position determining member 21 is provided in a rotating cam for performing the movement of the separation slope 2, and thus the sheet tip position determining member 21 is moved so that the position of the sheet tip position determining member 21 and the disposition of the separation slope 2 is the same as the position of the sheet tip position determining member 17 and the disposition of the separation slope 2 according to the first embodiment.

Because of this, since the configuration of the cam portion becomes slightly more complicated than that of the above-described embodiments and the sheet tip position determining member 21 is not provided in the separation slope 2, the disposition accuracy of the sheet tip position determining member 21 relative to the separation slope 2 also is degraded, but it is possible to produce an effect similar to that of the above-described embodiments.

Others

In the above-described embodiments, although a configuration in which a sheet tip position determining member is provided has been described, the present invention may include no sheet tip position determining member. In this case, although operability is slightly degraded, when inkjet printing apparatus are provided at a low cast, the inkjet printing apparatus may include no sheet tip position determining member, and may be configured to perform the positioning of the tip portion of the sheet P by the separation slope 2.

In addition, it goes without saying that θ1, θ2, L1, L2, and the like used in the above-described embodiments are not limited to the above-described values.

It should be noted that the present invention can be applied not only to printing apparatus, but also to any apparatus for performing some kind of processing on a sheet such as, for example, a fax machine.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-145575, filed Jun. 30, 2011, which is hereby incorporated by reference herein in its entirety.

What is claimed is:

1. A sheet conveying apparatus that conveys sheets, comprising:

a sheet stacking unit configured to stack the sheets thereon;

a sheet conveying unit configured to convey the sheets stacked on the sheet stacking unit;

a separation unit configured to separate a sheet of the uppermost portion by a separation slope that abuts a tip portion of the sheet conveyed by the sheet conveying unit;

a guide unit configured to guide the sheet separated by the separation unit; and a rotating unit configured to rotate the separation slope around a rotation center provided in a vicinity of a downstream end in a sheet moving direction of the separation slope so that an angle between the sheet stacking unit and the separation slope is changed, wherein the sheets are separated at a first angle in a case where the sheets have predetermined rigidity, and the sheets are separated at a second angle in a case where the sheets have a rigidity lower than the predetermined rigidity.

2. The sheet conveying apparatus according to claim 1, wherein a minimum distance between the sheet mounted on the sheet stacking unit and the separation slope when the first angle is formed is shorter than a minimum distance between the sheet mounted on the sheet stacking unit and the separation slope when the second angle is formed.

3. The sheet conveying apparatus according to claim 1, wherein the rotation center is provided in a vicinity of upstream end in a sheet moving direction of the guide unit.

4. A sheet conveying apparatus that conveys sheets, comprising:

a sheet stacking unit configured to stack the sheets thereon;

a sheet conveying unit configured to convey the sheets stacked on the sheet stacking unit;

a separation unit configured to separate a sheet of the uppermost portion by a separation slope that abuts a tip portion of the sheet conveyed by the sheet conveying unit;

a guide unit configured to guide the sheet separated by the separation unit; and a rotating unit configured to rotate the separation slope around a rotation center provided in a vicinity of a downstream end in a sheet moving direction of the separation slope so that an angle between the sheet stacking unit and the separation slope is changed, wherein switching of an angle of the separation unit is set based on torque information of a driving source of the sheet conveying unit.

5. A sheet conveying apparatus that conveys sheets, comprising:

a sheet stacking unit configured to stack the sheets thereon;

a sheet conveying unit configured to convey the sheets stacked on the sheet stacking unit;

a separation unit configured to separate a sheet of the uppermost portion by a separation slope that abuts a tip portion of the sheet conveyed by the sheet conveying unit;

a guide unit configured to guide the sheet separated by the separation unit; and a rotating unit configured to rotate the separation slope around a rotation center provided in a vicinity of a downstream end in a sheet moving direction of the separation slope so that an angle between the sheet stacking unit and the separation slope is changed, wherein switching of an angle of the separation unit is set based on information in which the sheet is not conveyed to a subsequent process in conveying by the sheet conveying unit.

6. A printing apparatus that performs printing on sheets, comprising:

a sheet stacking unit configured to stack the sheets thereon;

a sheet conveying unit configured to convey the sheets stacked on the sheet stacking unit;

a separation unit configured to separate a sheet of the uppermost portion by a separation slope that abuts a tip portion of the sheet conveyed by the sheet conveying unit;

a guide unit configured to guide the sheet separated by the separation unit;

a printing unit configured to print on the sheet guided by the guide unit; and a rotating unit configured to rotate the separation slope around a rotation center provided in a vicinity of an upstream end in a sheet moving direction of the guide unit slope so that an angle between the sheet stacking unit and the separation slope is changed, wherein the sheets are separated at a first angle in a case where the sheets have predetermined rigidity, and the sheets are separated at a second angle in a case where the sheets have rigidity lower than the predetermined rigidity.

7. A processing apparatus that performs processing on sheets, comprising:

a sheet stacking unit configured to stack the sheets thereon;

a sheet conveying unit configured to convey the sheets stacked on the sheet stacking unit;

a separation unit configured to separate a sheet of the uppermost portion by a separation slope that abuts a tip portion of the sheet conveyed by the sheet conveying unit;

a guide unit configured to guide the sheet separated by the separation unit; and a rotating unit configured to rotate the separation slope around a rotation center provided in a vicinity of a downstream end in a sheet moving direction of the separation slope so that an angle between the sheet stacking unit and the separation slope is changed, wherein the sheets are separated at a first angle in case the sheets are a first type, and the sheets are separated at a second angle in case the sheets are a second type.

8. A sheet separating apparatus comprising:

a stacking unit on which the sheets are stacked;

a conveying unit configured to convey at least an uppermost sheet stacked on the stacking unit;

a separation unit having a slope configured to separate the uppermost sheet to which a leading edge of the sheet conveyed by the conveying unit abuts; and a changing unit configured to change an angle of the slope with respect to a direction where the conveying unit conveys a sheet, wherein the changing unit changes the angle of the slope according to a type of the sheet to be conveyed before the conveying unit conveys the sheet stacked on the stacking unit.

9. The sheet separating apparatus according to claim 8, wherein the changing unit sets the angle of the slope to a first angle to separate the sheets having a first rigidity, and sets the angle of the slope to a second angle larger than the first angle to separate the sheets having a second rigidity higher than the first rigidity.

10. The sheet separating apparatus according to claim 8, wherein the changing unit comprises a cam that contacts the separation unit.

11. The sheet separating apparatus according to claim 10, wherein the cam contacts a side, which does not face the sheets stacked on the stacking unit, of the separation unit.

12. The sheet separating apparatus according to claim 8, further comprising a guide unit configured to guide the sheet separated by the separation unit, wherein the rotation center is provided in a vicinity of an upstream end in a sheet moving direction of the guide unit.

13. The sheet separating apparatus according to claim 8, wherein the changing unit changes the angle of the slope by rotating the slope around a rotation center provided in a vicinity of a downstream end in a sheet moving direction of the separation slope while the sheet does not contact the separation slope.

* * * * *